US005492288A

United States Patent [19]

Bordelon

[11] Patent Number: 5,492,288

[45] Date of Patent: Feb. 20, 1996

[54] KITE FRAMING-MEMBER CONNECTOR

[76] Inventor: Raymond J. Bordelon, 5717 Rosemary Pl., New Orleans, La. 70124

[21] Appl. No.: 383,779

[22] Filed: Feb. 6, 1995

[51] Int. Cl.[6] ..... A63H 27/08; A63H 27/18

[52] U.S. Cl. ..... 244/155 R; 244/153 R

[58] Field of Search ..... 244/153 R, 155 R, 244/900, 904

[56] References Cited

U.S. PATENT DOCUMENTS

| | | | |
|---|---|---|---|
| 2,149,844 | 3/1939 | George | 244/30 |
| 4,113,206 | 9/1978 | Wheeler | 244/31 |
| 4,116,407 | 9/1978 | Murray | 244/900 |
| 4,198,019 | 4/1980 | Linczmajer | 244/153 R |
| 4,286,762 | 9/1981 | Prouty | 244/153 R |
| 4,969,615 | 11/1990 | Gellert | 244/153 R |
| 5,149,021 | 9/1992 | Prouty | 244/153 R |
| 5,152,481 | 10/1992 | Cote et al. | 244/153 R |
| 5,251,854 | 10/1993 | Iwamoto | 244/153 R |
| 5,322,247 | 6/1994 | Munday et al. | 244/153 R |
| 5,328,134 | 7/1994 | Powers | 244/155 A |

*Primary Examiner*—Andres Kashnikow
*Assistant Examiner*—Virna Lissi Mojica
*Attorney, Agent, or Firm*—Joseph N. Breaux

[57] ABSTRACT

A kite framing-member connector for forming a connection between at least two elongated kite framing-members. The kite framing-member connector comprises: a first framing-member connection fitting attached to a second framing-member connecting mechanism. The first framing-member connection fitting is adapted to receive and hold the end of a framing-member such as a spreader. The second framing-member connecting mechanism includes a flap portion having a flexible, flap-end portion that is securable to a kite framing-member, such as a leading edge spar, by surrounding and gripping a section of the kite framing-member. It is preferred to include an attachment structure carried on the flap-end portion that is connectable with a harness line in a manner such that tensional force on the harness line causes the second framing-member connecting mechanism to increase the gripping force applied to the section of the second kite framing-member about which the flap portion is secured.

16 Claims, 4 Drawing Sheets

KITE FRAMING-MEMBER CONNECTOR

TECHNICAL FIELD

The present invention relates to devices for constructing kites, and more particularly to devices for connecting framing-members together to form a kite frame.

BACKGROUND ART

A typical kite includes a sail, a support frame, and a harness. The sail is generally constructed from a strong, lightweight material, such as nylon, that is supported on the support frame. The support frame is generally constructed of multiple framing-members that are connectable to form the support frame using framing-member connectors. The harness is tied to the kite in at least two and, preferably, four or more locations on the framing members.

It is known in the art to utilize a modified section of plastic or rubber tubing as a framing-member connector. The tubing section is modified by placing two holes through the tubing sidewall near one end of the tube section. This connection is typical when connecting the spreader framing-member between the leading edge spar framing-members. A stop is generally provided and adhesively connected to the leading edge spars as an aid in properly positioning the connector.

The connections between the sail, the leading edge spars and the spreaders are typically accomplished in the following manner. Each leading edge spar is inserted into one of the sleeves forming the leading edge of the sail. Each sleeve includes one or more cut out sections, or apertures, through which the connection between the leading edge spar and the spreader is accomplished. As the leading edge spar reaches each cut-out, the end of the tubing having the two sidewall holes is placed into the cut-out and the leading edge spar inserted through the sidewall holes and onward through the sleeve to succeeding cut-outs. One end of the spreader is then inserted into the end of the tubing section extending away from the leading edge spar.

It is also known to construct, by molding or casting, framing-member connectors that function as previously described but which provide a more professionally manufactured appearance. One framing-member connector, constructed of a rigid plastic and manufactured in this manner, includes a hinged connection between the two framing-member connection mechanisms and one of the connecting mechanisms includes a gap running longitudinally along its length.

Although this provides an adequate connection between the framing-members this method of connection has some drawbacks. For example, this type connection requires cutting out sections of the leading edge sail sleeve. The cut-outs create pockets that can cause undesirable airflow patterns to develop over the airfoil section of the sail, and, thereby, hinder performance of the kite. In addition, the cut-outs provide an avenue for dirt and other debris to enter and accumulate within the sail's leading edge sleeve. Also, because the connection is generally accompanied by the gluing of stops on the leading edge spars, the leading edge spars are not easily removable from the leading edge sleeve once installed. This can be a problem during competitions when it is necessary to rapidly replace a damaged leading edge spar.

Another drawback inherent in previous connections is the end of the tube that protrudes past the two sidewall holes. The protruding end can snag on the flying line and cause the kite to fall from the sky. This type connection also inhibits the deflection spine orienting of leading edge spars. It would be desirable to have a kite framing-member connector that eliminated some or all of these drawbacks.

GENERAL SUMMARY DISCUSSION OF INVENTION

It is the overall object of the invention to provide a kite framing-member connector that will increase the enjoyment of kite flying by increasing the speed of assembly and repair of the kite at the flying site.

It is also an object of the invention to provide a kite framing-member connector that may be used in conjunction with a kite sail without the need for providing leading edge cutouts on the sleeves forming the leading edge of the kite sail.

It is a further object of the invention to provide a kite framing-member connector that allows the framing-members of the kite to rotate freely so that they may orient themselves to a position of similar deflection.

It is a still further object of the invention to provide a kite framing-member connector that provides a stronger connecting force between the framing-members under high wind conditions.

It is a still further object of the invention to provide a kite framing-member that includes a harness attachment mechanism for securing a harness line to the frame.

Accordingly, a kite framing-member connector for forming a connection between at least two elongated kite framing-members of the type having a longitudinal axis is provided. The kite framing-member connector comprises: a first framing-member connection fitting attached to a second framing-member connecting mechanism. The first framing-member connection fitting is adapted to receive and hold the end of a framing-member such as a spreader.

The second framing-member connecting mechanism includes a flap portion having a flexible, flap-end portion that is securable about a kite framing-member, such as a leading edge spar, by surrounding and gripping a section of the kite framing-member. The flap-end portion preferably includes at least a section thereof constructed from a resilient material and, more preferably, includes at least a section constructed in a manner such that the flap-end portion resiliently returns to a predetermined position when not subjected to a deforming force. When the flap-end portion is in the first predetermined position, the flap portion preferably forms a substantially tubular gripping chamber. The durometer rating of the resilient material is preferably between 60 and 100 on the Shore A scale.

Although the flap portion may be constructed from a material having sufficient resiliency to resiliently grip and hold the framing-member, it is preferred to include an attachment structure carried on the flap-end portion that is connectable with a harness line in a manner such that tensional force on the harness line causes the second framing-member connecting mechanism to increase the gripping force applied to the section of the second kite framing-member about which the flap portion is secured. The attachment structure preferably includes an aperture, formed through the flap-end portion, of a size sufficient to allow the end of the harness line to be threaded therethrough and, more preferably, includes a first and second aperture. The first aperture is formed through the flap-end portion. The second aperture is formed through the flap portion and disposed on the flap portion in a position and a manner such that the first and second apertures are aligned when the flap-end portion forms a substantially tubular gripping chamber. The harness line is then treaded through both apertures. It is desirable to crimp an elongated metal ferrule, such as a one-headed rivet, to the end of the harness line. In this configuration, the diameter of the first and second aperture are selected to snugly receive therein the rivet.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
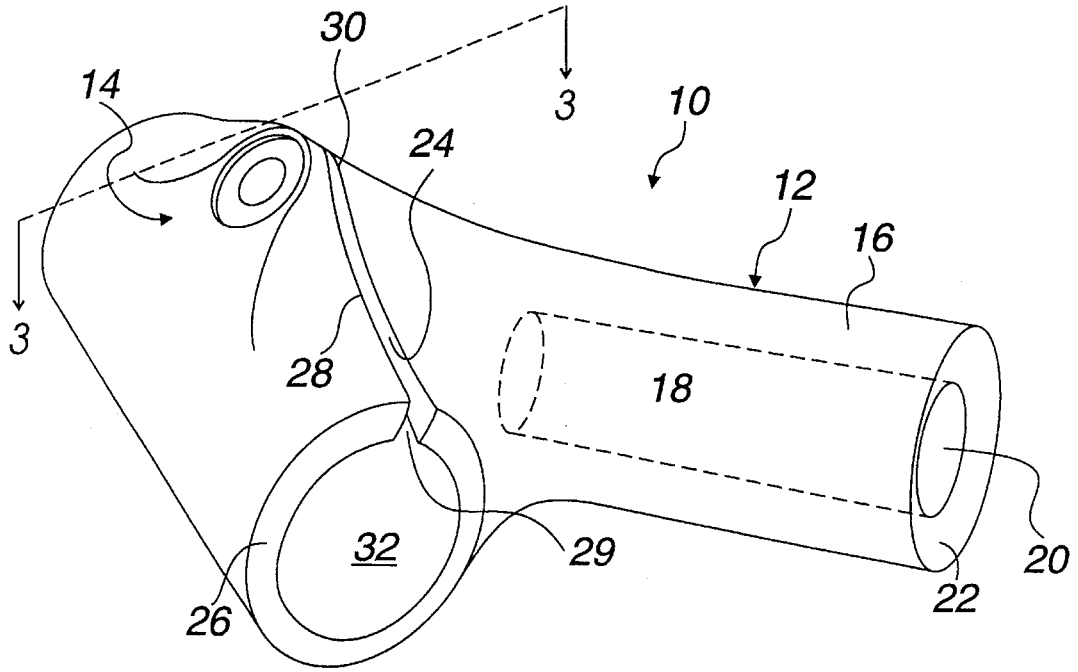
FIG. 1 is a perspective view of an exemplary embodiment of the framing-member connector of the invention with the flap-end portion in the first predetermined position.

FIG. 1 shows a perspective view of an exemplary embodiment of the framing-member connector of the present invention, generally designated by the numeral 10. Framing-member connector 10 includes a first framing-member fitting, generally referenced by the numeral 12, and a second framing-member connecting mechanism, generally referenced by the numeral 14. In this embodiment, fitting 12 and connecting mechanism 14 are integrally molded using a centrifugal casting method from a polyurethane prepolymer that, when mixed with a catalyst, solidifies to a durometer reading on the shore A scale of about 90.

Fitting 12 includes a resilient outer portion 16 that forms an elongated aperture 18 that is open at one end 20. Elongated aperture 18 is about one inch deep and has a diameter of about one-quarter (¼") of an inch. Open end 20 is defined by a beveled lip 22 that is angled into aperture 18. Beveled lip 22 aids insertion of a framing-member end into aperture 18.

Connecting mechanism 14 includes a flap portion generally designated by the numeral 24 and a flap-end portion 26. As shown in the figure, flap-end portion 26 is positioned in a first predetermined position to which it resiliently returns when not under a deforming force. When in the first predetermined position, a gap 29 of about one-sixteenth (1/16") of an inch exists between an edge 28 of flap-end portion 26 and an edge 30 of flap portion 24. In addition, flap portion 24 and flap-end portion 26 form a gripping barrel, generally referenced by the numeral 32, when flap-end portion 26 is in the first predetermined position. Gripping barrel 32 has a length of about one inch (1") and a diameter of about five-sixteenths (5/16") of an inch. The longitudinal axis of gripping barrel 32 is oriented at about a 35 degree angle with respect to the longitudinal axis of aperture 18 at an angle of attack of about 10 degrees.

Figure 2:
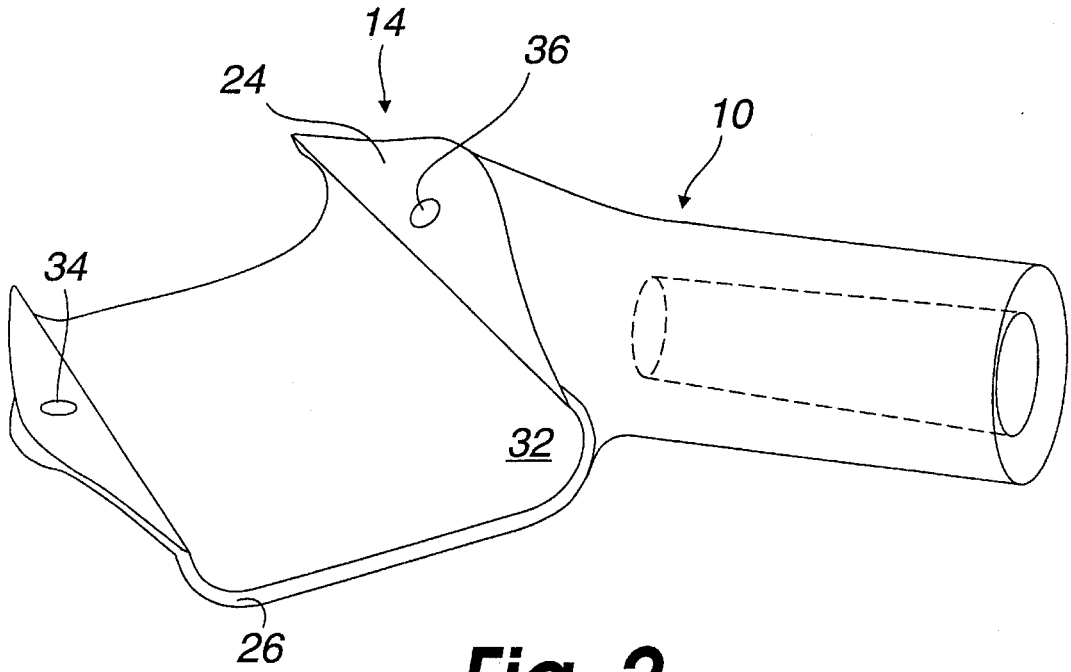
FIG. 2 is a perspective view of the exemplary embodiment with the flap-end portion forced out of the first predetermined position.

FIG. 2 shows framing member connector 10 with flap-end portion 26 forced out of the first predetermined position and more clearly shows flap portion 24. In this embodiment connector mechanism 14 includes a first aperture 34, formed through flap-end portion 26, and a second aperture 36, formed through flap portion 24. First and second apertures 34,36 are located about midway along the length of gripping barrel 32 and are substantially aligned when flap-end portion 26 is in the first predetermined position. The term "substantially aligned" is used herein to mean that a flexible line may be threaded through both apertures.

Figure 3:
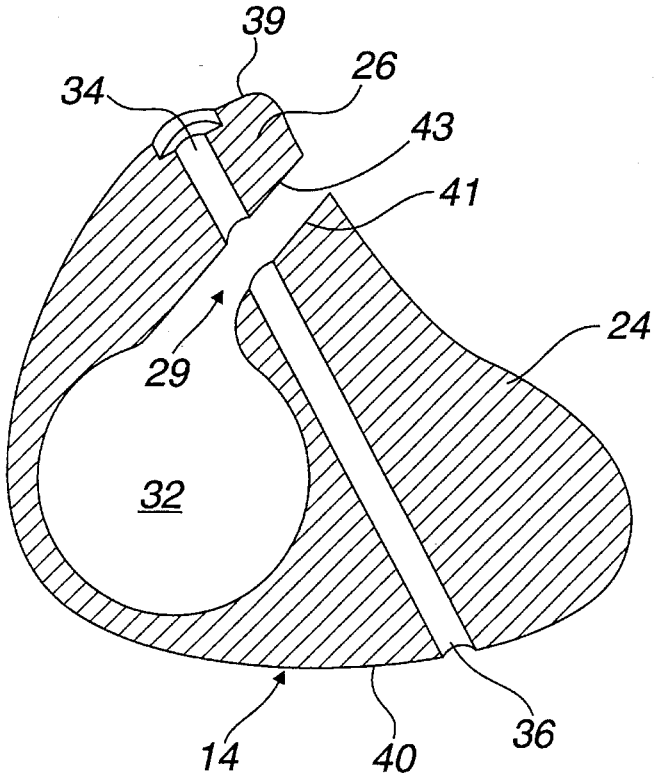
FIG. 3 is a perspective view showing the opposite side of the exemplary embodiment showing the outer surface positioning of the second attachment aperture.
Figure 4:
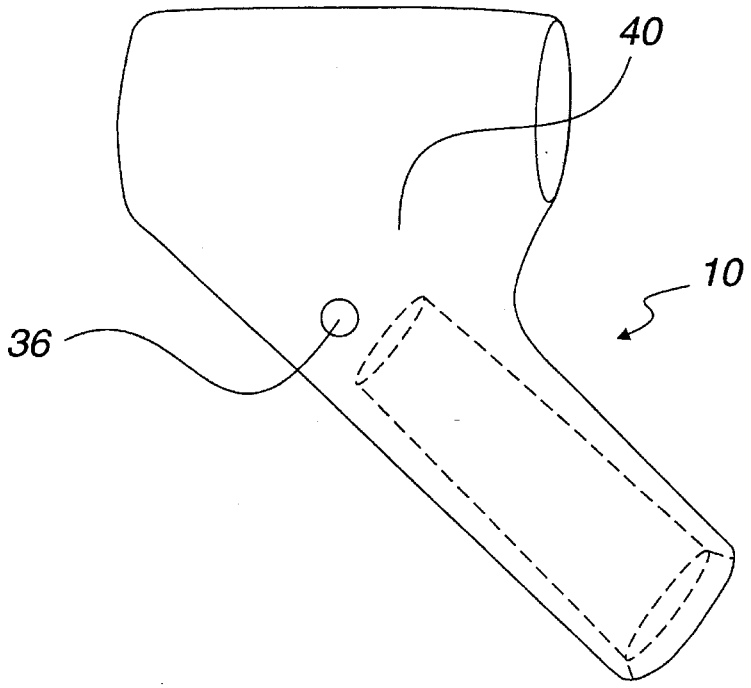
FIG. 4 is a schematic view of the second side of the exemplary embodiment of the framing-member connector of the invention.

FIG. 3, a cross-sectional view of connecting mechanism 14 along the line A—A of FIG. 1, more clearly illustrates gap 29 and the alignment of first and second apertures 34,36. As shown, first aperture 34 passes through the exterior 39 and through a surface 43 of flap-end portion 26. Second aperture 36 passes through surface 41 of flap portion 24 and exits through the flap portion second side 40 (shown in FIG. 4).

Because fitting 12 and connecting mechanism 14 are integrally formed, right and left side connectors are constructed. The embodiment of framing-member connector 10 previously described is adapted for use between the left leading edge spar and a spreader. An embodiment adapted for use with the right leading edge spar is a mirror image of the embodiment described with the mirror image taken from the plane defined by open end 20 of fitting 12.

Figure 5:
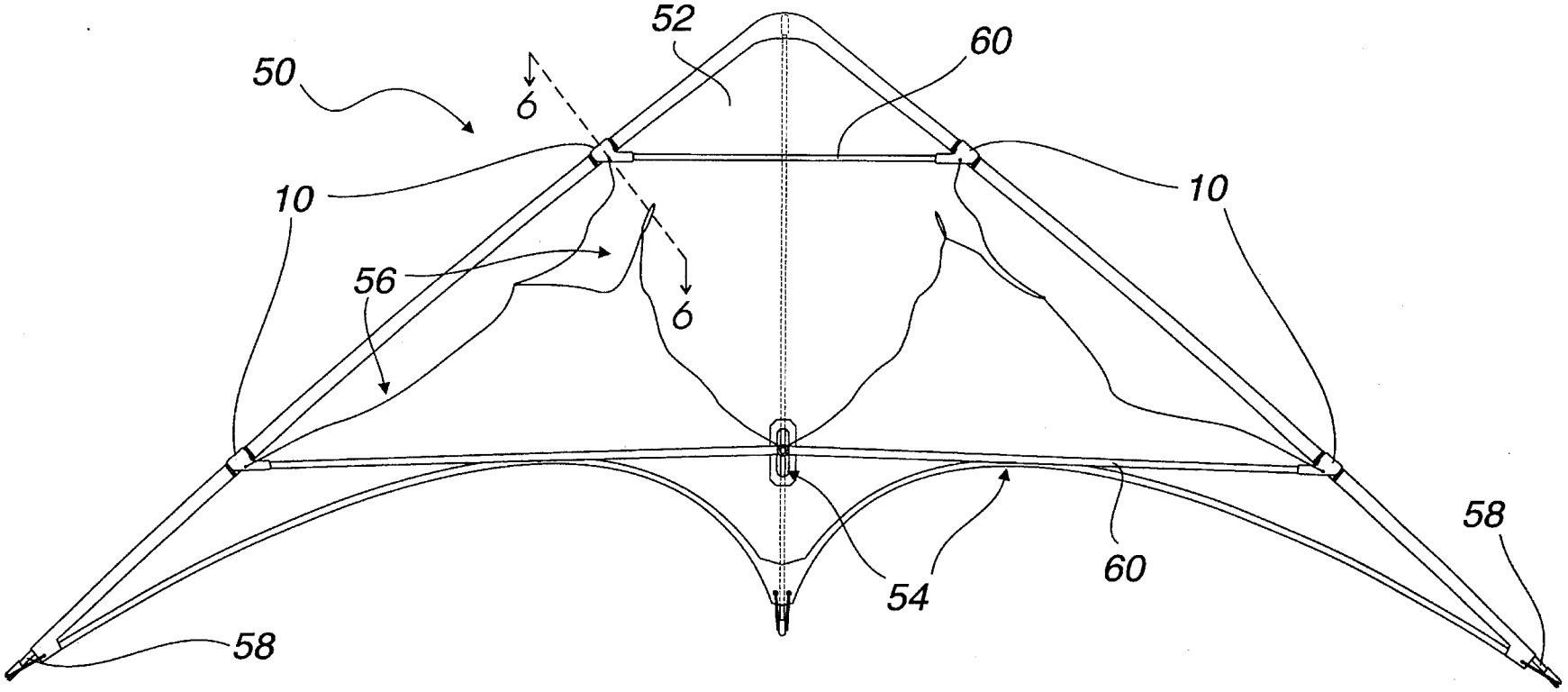
FIG. 5 is a front side schematic view of a representative kite frame utilizing exemplary embodiments of the framing-member connector of the invention.

FIG. 5 shows the front side of a representative kite 50. Kite 50 includes a cloth sail, generally designated by the numeral 52; a support frame, generally designated by the numeral 54; and a harness, generally designated by the numeral 56. Four connectors 10 are used to interconnect the leading edge spars 58 and the spreaders 60 of support frame 54.

Figure 6:
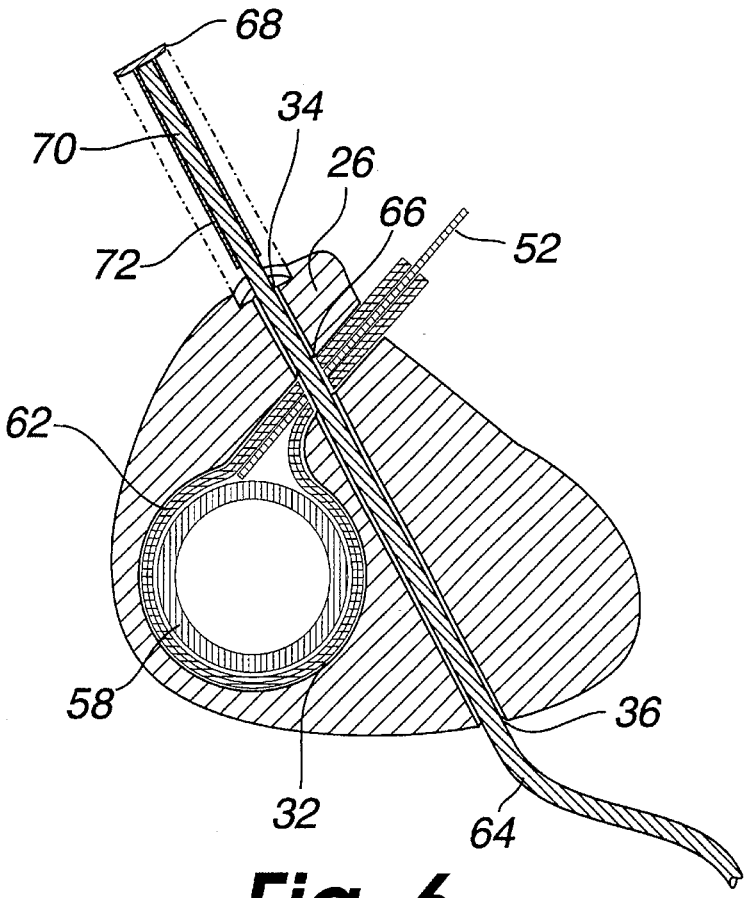
FIG. 6 is a cross-sectional view along the line B—B of FIG. 5.

FIG. 6 is a cross-sectional view along the line B—B of FIG. 5. FIG. 6 shows leading edge spar 58 disposed within the leading edge sleeve 62 of sail 53. Sleeve 62 is disposed within gripping barrel 32. A harness line 64 is threaded through second apertures 36, a hole 66 provided through sail 52, and then out through first aperture 34. Harness line 64 has a metal rivet 68 crimped to an end 70 thereof. Metal rivet 68 has an elongated stem portion 72 that passes through first aperture 34, hole 66, and into second aperture 36.

It can be seen that a tensional force on harness line 64 urges flap-end portion 26 into a tighter gripping relationship with leading edge spar 58. In addition, framing member connector 10 may used without requiring a cut-out section on the leading edge sleeve. The absence of a cut-out section eliminates the accumulation of turbulence creating pockets and the introduction of dirt and other debris within the sleeve. Also, the contoured profile of flap-end portion 26 against the leading edge sleeve of the sail minimizes snagging with with kite flying lines while the kite is in flight.

Figure 7:
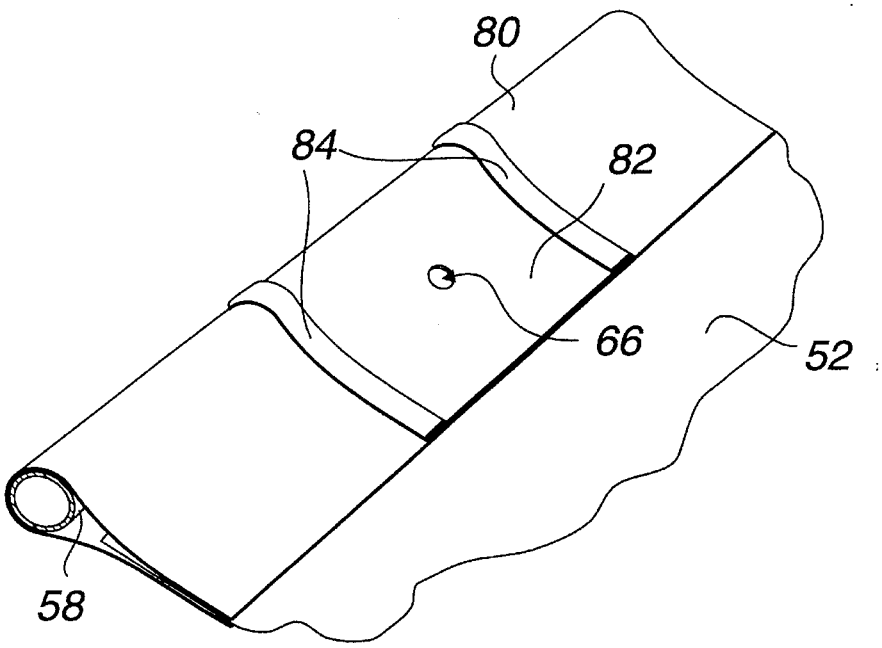
FIG. 7 is a detail perspective view of preferred modifications to the sail leading edge when using an embodiment of the framing-member connector.

FIG. 7 is a perspective, detail view of a preferred configuration for the sail leading edge sleeve 80. The configuration includes the addition of a section 82 of 3.9 ounce Dacron stitched to edge sleeve 80 having two rolled hems 84. Rolled hems 84 provide stops between which connecting mechanism 14 is positioned. In addition, hole 66 is preferably heat formed through section 82 as well as edge sleeve 80.

It can be seen from the preceding description that a kite framing-member connector that will increase the enjoyment of kite flying by increasing the speed of assembly and repair of the kite at the flying site; that may be used in conjunction with a kite sail without the need for providing leading edge cutouts on the leading edge of the kite leading edge sleeve; that allows the framing-members of the kite to rotate in a manner to allow the deflection spine of the framing-members to orient itself in flight; that provides a stronger connecting force between the framing-members under high wind conditions; and that includes a harness attachment mechanism for securing a harness line to the frame has been provided.

It is noted that the embodiment of the kite framing-member connector described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A kite framing-member connector for forming a connection between at least two elongated kite framing-members of the type having a longitudinal axis comprising, said kite framing-member connector comprising:

a first framing-member connecting means for orienting and holding a first framing-member having a longitudinal axis, said first framing-member connecting means including a member having an elongated aperture formed therein, said elongated aperture being open at an end thereof and adapted to receive therein in a frictionally gripping manner an end of a kite framing-member; and a second framing-member connecting mechanism, in connection with said first framing-member connecting means, having a flap portion including a flap-end portion securable about a section of a second kite framing-member, said flap-end portion including attachment means for securing a harness line thereto in a manner such that tensional force on said harness line causes said second framing-member connecting mechanism to increase a gripping force applied to said section of said second kite framing-member when said section is secured by said flap portion.

2. The kite framing-member connector of claim 1 wherein:

said attachment means includes a first aperture formed through said flap-end portion.

3. The kite framing-member connector of claim 2 wherein:

said attachment means includes a second aperture formed through said flap portion and disposed on said flap portion in a manner such that said first and second apertures are substantially aligned when said flap-end portion forms a substantially tubular gripping chamber.

4. A kite framing-member connector for forming a connection between at least two elongated kite framing-members of the type having a longitudinal axis, said kite framing-member connector comprising:

a first framing-member connecting means for orienting and holding a first framing-member having a longitudinal axis; and a second framing-member connecting mechanism, in connection with said first framing-member connecting means, having a flap portion including a flexible flap-end portion securable about a section of a second kite framing-member, said flap-end portion including attachment means for securing a harness line thereto in a manner such that tensional force on said harness line causes said second framing-member connecting mechanism to increase a gripping force applied to said section of said second kite framing-member when said section is secured by said flap portion.

5. The kite framing-member connector of claim 4 wherein:

said attachment means includes a first aperture formed through said flap-end portion.

6. The kite framing-member connector of claim 5, wherein:

said flap-end portion is at least partially constructed from a resilient material.

7. The kite framing-member connector of claim 6, wherein:

said flap-end portion resiliently returns to predetermined position when not subjected to a deforming force in a manner such that said flap portion forms a substantially tubular gripping chamber.

8. The kite framing-member connector of claim 5 wherein:

said attachment means includes a second aperture formed through said flap portion and disposed on said flap portion in a manner such that said first and second apertures are aligned when said flap-end portion forms a substantially tubular gripping chamber.

9. The kite framing-member connector of claim 8, wherein:

said flap-end portion is at least partially constructed from a resilient material.

10. The kite framing-member connector of claim 9, wherein:

said flap-end portion resiliently returns to predetermined position in a manner such that said flap portion forms a substantially tubular gripping chamber.

11. The kite framing-member connector of claim 5 wherein:

said flap portion is constructed of a resilient material having a Durometer of between 60 and 100.

12. A kite framing-member connector for forming a connection between at least two elongated kite framing-members of the type having a longitudinal axis, said kite framing-member connector comprising:

a first framing-member connecting means for orienting and holding a first framing-member having a longitudinal axis including a resilient member having an elongated aperture, open at one end, formed therein, said elongated aperture being adapted to receive therein, in a frictionally gripping manner an end of a kite framing-member and oriented at an angle between 20 and 160 degrees from a substantially straight framing-member having a section thereof disposed within said tubular gripping chamber formed by said lap end portion; and a second framing-member connecting mechanism, in connection with said first framing-member connecting means, having a flap portion including a flexible flap-end portion securable about a section of a second kite framing-member, said flap-end portion being at least partially constructed from a resilient material and resiliently returning to a predetermined position when not subjected to a deforming force in a manner such that said flap portion forms a substantially tubular gripping chamber.

13. The kite framing-member connector of claim 12 wherein:

said flap-end portion includes attachment means for securing a harness line thereto in a manner such that tensional force on said harness line causes said second framing-member connecting mechanism to increase a gripping force applied to said section of said second kite framing-member when said section is secured by said flap portion.

14. The kite framing-member connector of claim 12, wherein:

said first framing-member connecting means and said second framing-member connecting mechanism are integrally formed.

15. The kite framing-member connector of claim 13 wherein:

said attachment means includes a first aperture formed through said flap-end portion.

16. The kite framing-member connector of claim 15, wherein:

said first framing-member connecting means and said second framing-member connecting mechanism are integrally formed.

* * * * *